US007195125B1

(12) United States Patent
Wolseth

(10) Patent No.: US 7,195,125 B1
(45) Date of Patent: Mar. 27, 2007

(54) WINE BOTTLE SUPPORTS

(76) Inventor: Gary L. Wolseth, 1237 S. Troy St., Aurora, CO (US) 80012-4419

( * ) Notice: Subject to any disclaimer, the term of this patent is extended or adjusted under 35 U.S.C. 154(b) by 0 days.

(21) Appl. No.: 11/492,363

(22) Filed: Jul. 24, 2006

Related U.S. Application Data

(63) Continuation of application No. 10/309,857, filed on Dec. 4, 2002, now Pat. No. 7,080,743.

(51) Int. Cl.
*A47B 73/00* (2006.01)

(52) U.S. Cl. ..... 211/74; 211/60.1; 211/85.18

(58) Field of Classification Search ..... 211/74; 248/200; D7/619.1, 701, 603, 619, 621; D6/446, 465; 15/435
See application file for complete search history.

(56) References Cited

U.S. PATENT DOCUMENTS 3,286,849 A * 11/1966 Dominos ..... 211/74
3,606,023 A * 9/1971 Edmunds ..... 211/74
D250,625 S * 12/1978 Leventhal ..... D7/701
D252,004 S * 6/1979 Leventhal ..... D7/706
4,207,933 A * 6/1980 Howson ..... 141/106
D331,166 S * 11/1992 Ohadi ..... D6/570
5,180,066 A * 1/1993 McArdle ..... 211/74
5,197,612 A * 3/1993 Thomson ..... 211/74
5,264,043 A * 11/1993 Milocco ..... 134/25.2

FOREIGN PATENT DOCUMENTS

GB 2407970 A * 5/2005

* cited by examiner

*Primary Examiner*—Peter M. Cuomo
*Assistant Examiner*—Lindsay M. Maguire
(74) *Attorney, Agent, or Firm*—Ramon L. Pizarro; Edwin H. Crabtree

(57) ABSTRACT

A wine bottle rack that includes a first substantially rigid wall with an aperture adapted for accepting the neck of a wine bottle, and a second substantially rigid wall, the second substantially rigid wall having a plurality of apertures adapted for accepting the neck of a wine bottle. The apertures have been adapted for supporting the wine bottles in a cantilevered manner from the rack. The first substantially rigid wall is attached to the second substantially rigid wall, so that the first substantially rigid wall and the second substantially rigid wall are at an obtuse angle to one another.

3 Claims, 3 Drawing Sheets

WINE BOTTLE SUPPORTS

REFERENCE TO RELATED APPLICATIONS

This application is a continuation of my application having Ser. No. 10/309,857, filed Dec. 4, 2002 now U.S. Pat. No. 7,080,743, and which is incorporated herein in its entirety by reference.

BACKGROUND OF THE INVENTION (a) Field of the Invention

This invention generally relates to a support device for holding and storing a bottle. More particularly, but not by way of limitation, to a support for holding a long-necked bottle by the neck at an angle from the horizontal.

(b) Discussion of Known Art

The need for a device that supports long-necked bottles, such as wine bottles, has been know for some time. It is particularly important to store wine bottles at an angle, with the neck pointed generally downward in order to allow the wine to wet the cork and thus keep the cork from drying out and losing its desirable properties. Various known approaches provide some sort of a support wall or panel that include an aperture that has been adapted for engaging the bottle's neck. A problem associated with many of these devices is that they are often designed for replacing wine bottle racks that support a significant number of bottles, and thus take up a large amount of space and require correspondingly large footing supports.

Another limitation of known devices has been that they offer very little flexibility in the number of bottles that are to be supported by the wine rack. Typically, wine racks are designed to support a large number of bottles or a single bottle. While a large capacity rack is capable of supporting a single bottle, it is desirable to have a wine bottle rack that is versatile in that it can be a rack for supporting a single bottle or a multiple bottle rack.

Still another desirable feature in a wine rack is that the device be easily collapsed, so as to allow low cost shipping.

Another desirable feature in a wine rack is that it should incorporate few, if any, moving parts while still maintaining the ability to support wine bottles.

SUMMARY

It has been discovered that the problems left unanswered by known art can be solved by providing a rack for supporting a long-neck bottle, the neck of the bottle being generally cylindrical, the wine rack comprising:

a first substantially rigid wall, the first substantially rigid wall having an aperture therein, the aperture being adapted for accepting the neck of the bottle and supporting the bottle in a cantilevered manner from the aperture;

a second substantially rigid wall, the second substantially rigid wall having a plurality of apertures therein, each of the aperture being adapted for accepting the neck of the bottle and supporting the bottle in a cantilevered manner from the aperture, the first substantially rigid wall being attached to the second substantially rigid wall, so that the first substantially rigid wall and the second substantially rigid wall are at an obtuse angle to one another.

According to one example of the invention, the first substantially rigid and the second substantially rigid wall are made from wood panels that include generally round holes that define the apertures that are adapted for accepting the neck of the bottles, and then supporting the bottles from the device by allowing the weight of the bottle to cause the neck of the bottle to bear against the aperture.

Importantly, in an example of the invention, the first substantially rigid wall will include more apertures than the second substantially rigid wall. The obtuse angle of the two substantially rigid walls will allow the user to select which wall will serve as the base. If the user has only one wine bottle that he wishes to support, then the user will simply place the substantially rigid wall with several apertures over the support surface, such as a table, shelf, floor or other support. This will position the wall with a single aperture at an angle to the support surface, allowing the user to support the wine bottle from the wall with a single aperture.

According to other examples disclosed herein, it is contemplated that one of the walls will be made with a portion that is inserted into the second wall, where it will allow the device to assume the obtuse angled shape. This structure will allow the invention be collapsed to allow shipping in smaller containers, and thus reduce the cost of shipping.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
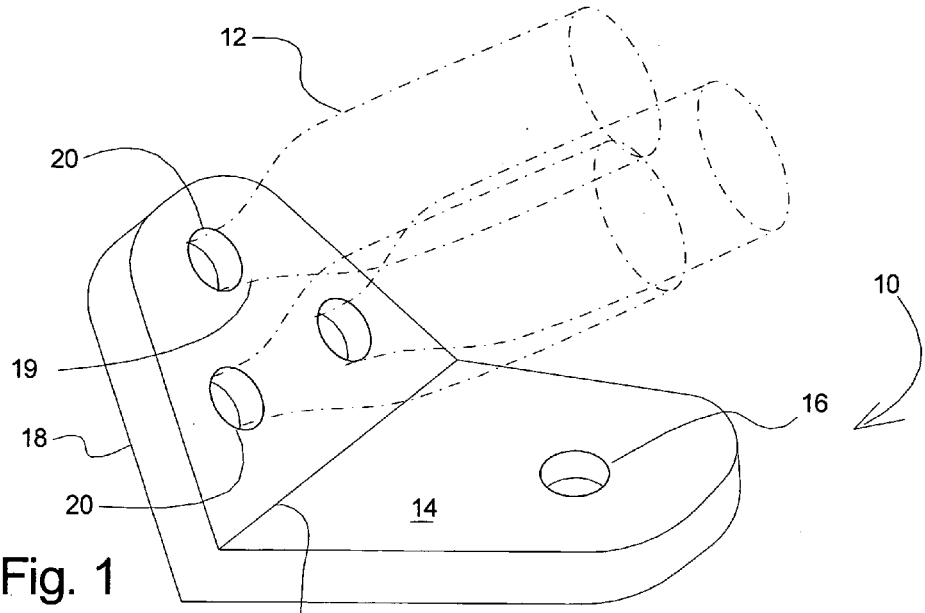
FIG. 1 is a perspective view of an embodiment of the invention with a first substantially rigid wall and a second substantially rigid wall.
Figure 3:
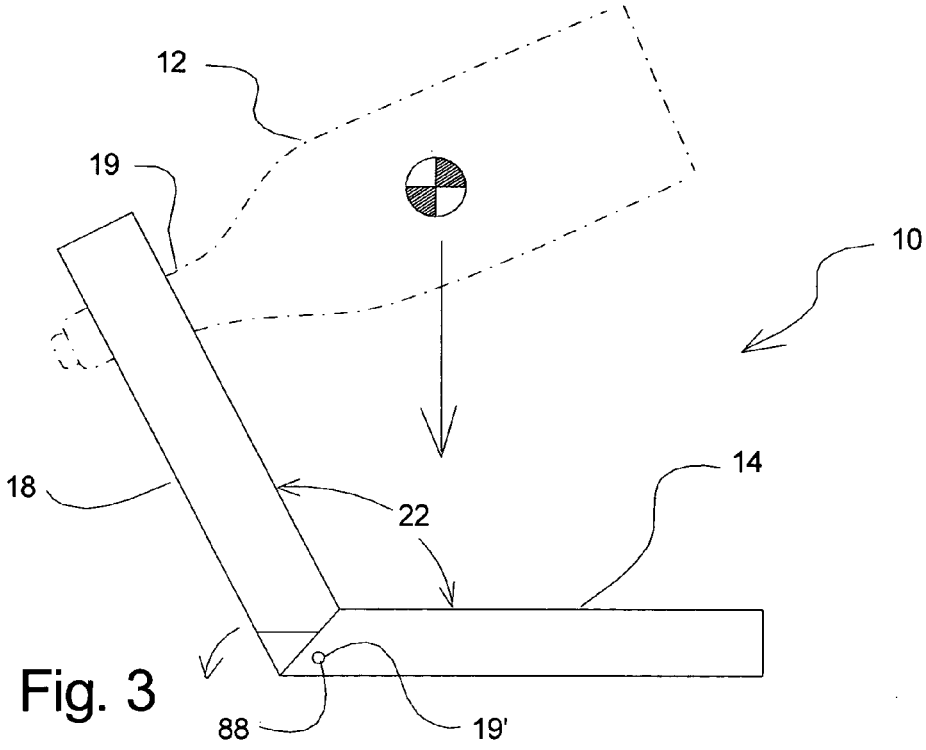
FIG. 3 is a side view of an example of the wine rack with a first substantially rigid wall and a second substantially rigid wall supporting a single wine bottle over the second substantially rigid wall.

Turning now to FIGS. 1 and 3, where a rack 10 for supporting at least one long-necked bottle 12 such as a wine bottle, the long-necked bottle being generally cylindrical. The rack 10 including generally planar first substantially rigid wall 14 that includes an aperture 16 therethrough. As illustrated in the enclosed figures, the aperture 16 has been adapted for accepting the neck 18 of the bottle 12 and supporting the bottle 12 in a cantilevered manner from the aperture 16.

Attached to the first substantially rigid wall 14 is a generally planar second substantially rigid wall 18. Preferably, the second substantially rigid wall 18 will be joined to the first substantially rigid wall 14 along a joint line 19'. According to a preferred example of the invention, the second substantially rigid wall 18 is of approximately the same size as the first substantially rigid wall 14. It is contemplated that by making the first substantially rigid wall 14 and the second substantially rigid wall 18 of approximately the same size, the manufacturer of the rack 10 may cut both substantially rigid walls using the same pattern, and then cut the needed apertures in each of the respective substantially rigid walls before joining the first substantially rigid wall 14 and the second substantially rigid wall 18 together to form the rack 10.

Also illustrated in FIG. 1, is that it is contemplated that the second substantially rigid wall 18 will include at least two apertures 20 therethrough. Each of the apertures 20 will be adapted for accepting the neck 18 of the bottle 12 and supporting the bottle in a cantilevered manner from each of the apertures 20.

Figure 5:
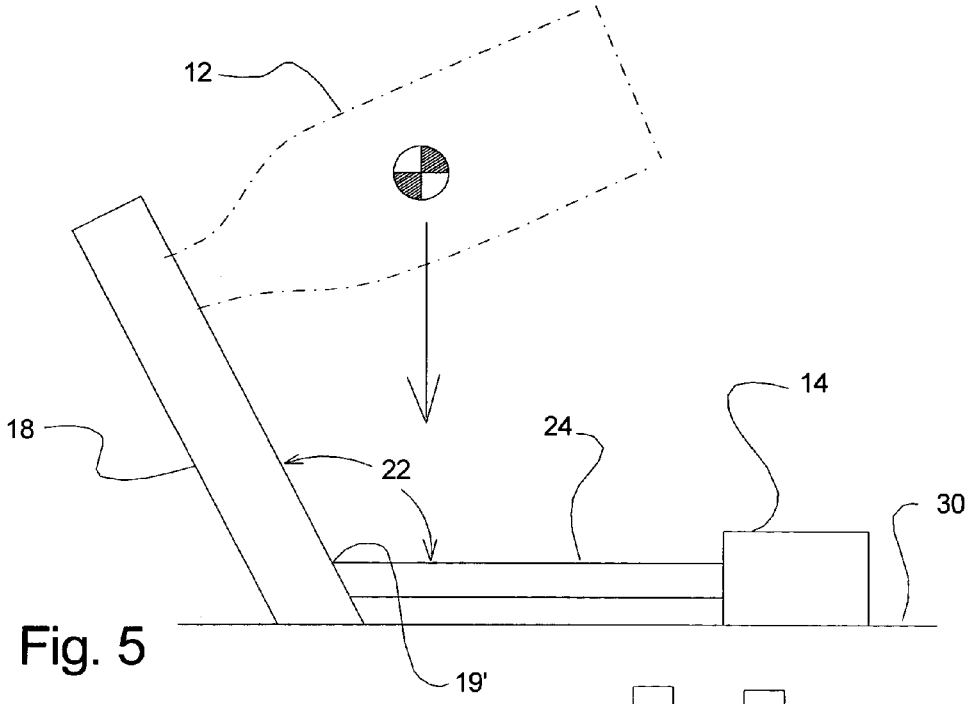
FIG. 5 is a side view of an example of the wine rack with a first substantially rigid wall and a second substantially rigid wall, the example illustrating the use of a dowel to connect the walls.

As shown in FIGS. 1, 3, and 5, the first substantially rigid wall 14 will be attached to the second substantially rigid wall 18, so that the first substantially rigid wall 4 and the second substantially rigid wall 18 are at an obtuse angle 22 to one another. It is contemplated that the obtuse angle 22 may be achieved by molding or welding the two substantially rigid wall panels to one another to form a rack of one piece, unitary construction, or by fastening or adhering the two wall panels together. Additionally, it is contemplated that the two wall panels may be joined to one another by a hinged connection, illustrated in FIG. 3, that includes a stop or is limited to motion that prevents the two wall panels from closing against one another and reducing or eliminating the obtuse angle 22.

Figure 6:
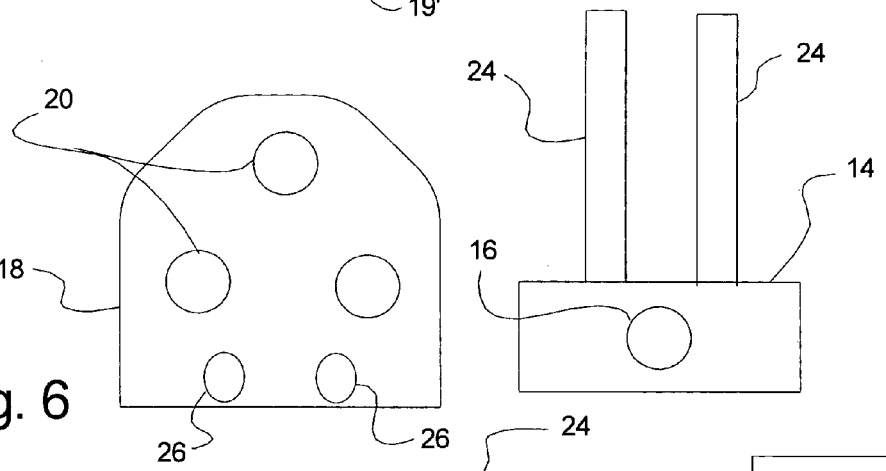
FIG. 6 illustrates the components of the example shown in FIG. 5 while disassembled.
Figure 7:
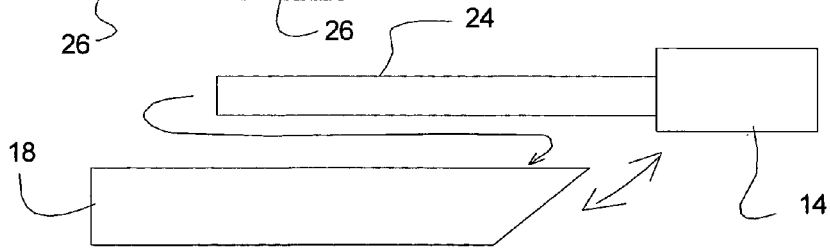
FIG. 7 illustrates the stacking of the components of the example shown in FIG. 5.

It is contemplated that the disclosed rack 10 may be sold by mail order or though the Internet. Thus, it is desirable to produce the rack 10 in a manner that allows packaging of the rack 10 in as small of a container as possible. When this feature is desired, it is contemplated that the rack 10 may be made with the use of a connecting dowel 24 or rod that joins the first substantially rigid wall 16 to the second substantially rigid wall 18. Turning to FIGS. 5–7 it will be understood that the dowel 24 may be a long section that joins the two walls. In this example the first substantially rigid wall 16 and the second substantially rigid wall 18 are not of the same size, and thus cannot offer the same manufacturing advantages as the example illustrated in FIGS. 1 and 3. However, as illustrated in FIGS. 5 and 7, the use of long dowel 24 will allow easy separation and stacking, illustrated in FIG. 7, as well as easy assembly by inserting the dowel 24 into an aperture 26 in the second substantially rigid wall 18.

It will be understood that in use, the disclosed rack 10 will allow a user to use the rack to support a single wine bottle by supporting the bottle from the first substantially rigid panel 18. To do this, the user would simply use the second substantially rigid wall 18 as a base to support the rack 10 from a support surface 30, such as a table, shelf, floor or other surface. If the user wishes to support several wine bottles, then the user would simply place the first substantially rigid wall 16 against the support surface 30, and insert the wine bottles into the apertures in the second substantially rigid wall 18. Thus it will be understood that the disclosed rack 10 will create an aesthetically pleasing display when a single bottle is being supported, while providing the versatility of adding more bottles and still maintaining an aesthetically pleasing display while properly supporting the wine bottles, such that the cork will not dry out.

Figure 2:
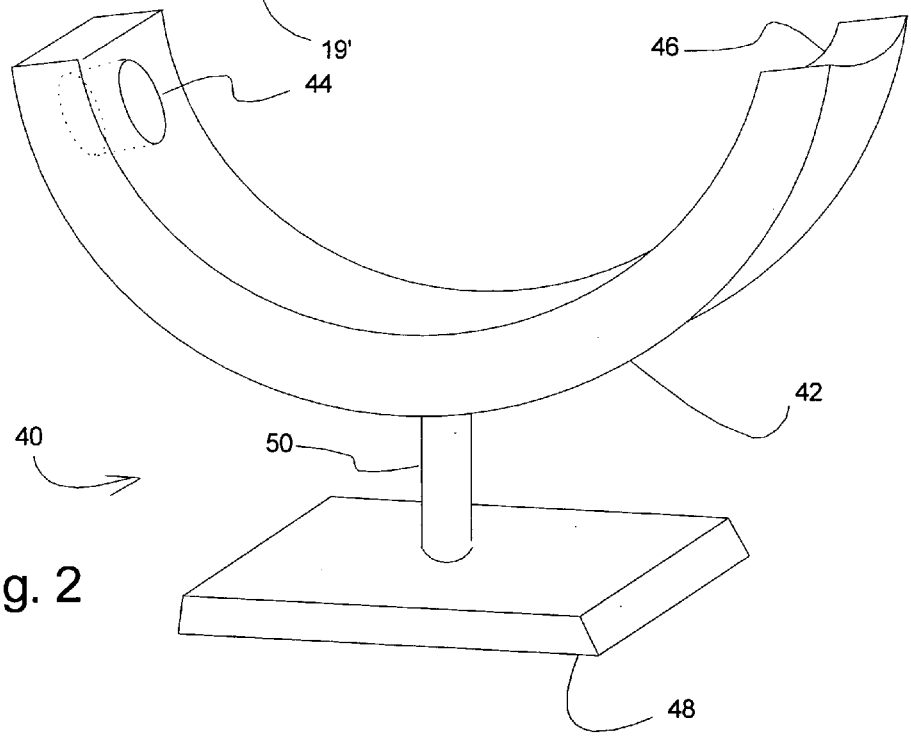
FIG. 2 is a perspective view of a wine rack with the curved support.
Figure 4:
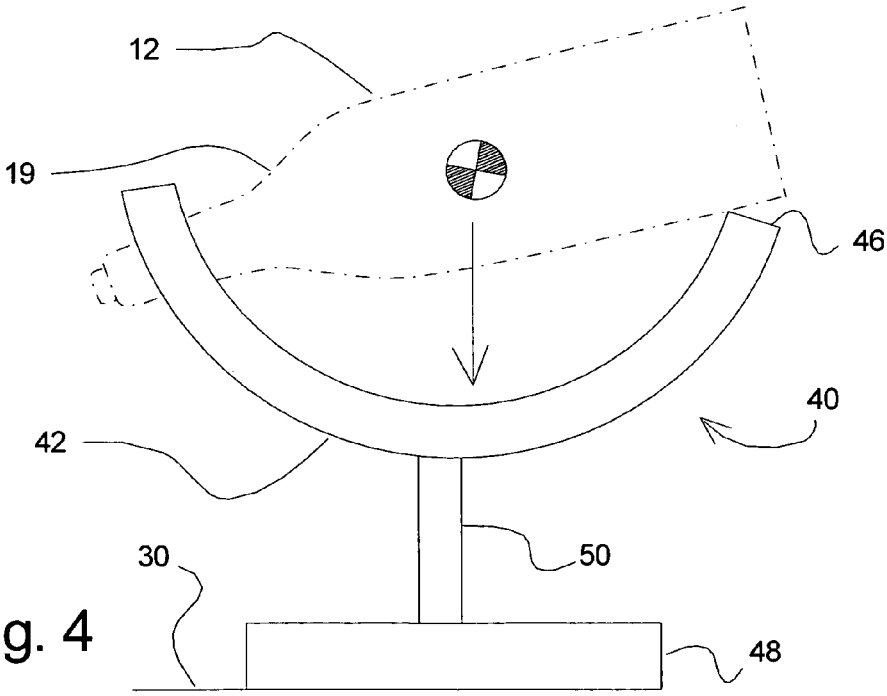
FIG. 4 is a side view of the rack illustrated in FIG. 2.

Turning to FIGS. 2 and 4 where an example of a wine rack 40 with a curved support 42 has been illustrated, it will be understood that the wine rack 10 will provide additional versatility that cannot be achieved with the wine rack 40 with the curved support 42. Importantly, the wine rack 10 will support several wine bottles. Whereas the wine rack 40 with the curved support 42 will provide support for a single wine bottle. The wine rack 40 with the curved support 42 will support the single bottle by providing a neck support recess 44 and a bottle body support recess 46. The curved support 42 will in turn be supported from a base 48 and pedestal post 50.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A rack for supporting at least one long-necked bottle, the rack comprising:

a first substantially rigid wall, the first substantially rigid wall having an aperture therethrough, the aperture being adapted for accepting the neck of the bottle and supporting the bottle in a cantilevered manner from the aperture;

a second substantially rigid wall, the second substantially rigid wall having a plurality of apertures therethrough, each of the aperture in the second substantially rigid wall being adapted for accepting the neck of the bottle and supporting the bottle in a cantilevered manner from the aperture, the first substantially rigid wall being rigidly attached to the second substantially rigid wall through a pair of connecting dowels that extend between the first substantially rigid wall and the second substantially rigid wall, so that the first substantially rigid wall and the second substantially rigid wall are at an obtuse angle to one another.

2. A rack according to claim 1 wherein said first substantially rigid wall contains one aperture theretrough, and said second substantially rigid wall contains two or more apertures therethrough, each of the apertures in the first substantially rigid wall and in the second substantially rigid wall being adapted for accepting the neck of the bottle theretrough, and for supporting the bottle in a cantilevered fashion.

3. A method for supporting a wine bottle, the method comprising:

providing a rack for supporting at least one long-necked bottle, the long-necked bottle being generally cylindrical, the rack comprising:

a first substantially rigid wall, the first substantially rigid wall having an aperture therethrough, the aperture being adapted for accepting the neck of the bottle and supporting the bottle in a cantilevered manner from the aperture;

a second substantially rigid wall, the second substantially rigid wall having a plurality of apertures therethrough, each of the apertures in the second substantially rigid wall being adapted for accepting the neck of the bottle and supporting the bottle in a cantilevered manner from the aperture, the first substantially rigid wall being rigidly attached to the second substantially rigid wall through a pair of connecting dowels that hold the first substantially rigid wall and the second substantially rigid wall spaced from one another and at an obtuse angle to one another;

placing the first substantially rigid wall against a support surface when supporting several wine bottles; and placing the second substantially rigid wall against the support surface when supporting a plurality of wine bottles with the rack.

* * * * *